US007585091B2

(12) United States Patent
Wang

(10) Patent No.: US 7,585,091 B2
(45) **Date of Patent: *Sep. 8, 2009**

(54) LIGHT SHADES AND LIGHTING SYSTEMS

(76) Inventor: Jessica Wang, 16F-3, No. 70, Sec. 2, Tun-Hua South Road, Taipei (TW)

( * ) Notice: Subject to any disclaimer, the term of this patent is extended or adjusted under 35 U.S.C. 154(b) by 0 days.

This patent is subject to a terminal disclaimer.

(21) Appl. No.: 11/926,905

(22) Filed: Oct. 29, 2007

(65) Prior Publication Data

US 2008/0186706 A1 Aug. 7, 2008

Related U.S. Application Data

(63) Continuation of application No. 11/039,375, filed on Jan. 19, 2005, now Pat. No. 7,303,312.

(51) Int. Cl.
*F21S 4/00* (2006.01)

(52) U.S. Cl. ..... 362/249.14; 362/244

(58) Field of Classification Search ..... 362/252, 362/121, 653, 806

See application file for complete search history.

(56) References Cited

U.S. PATENT DOCUMENTS

| | | | | |
|---|---|---|---|---|
| 1,589,018 | A * | 6/1926 | Ludwig | 362/121 |
| 1,684,922 | A * | 9/1928 | Mammen | 362/121 |
| 1,902,991 | A * | 3/1933 | Cardon | 362/806 |
| 2,173,032 | A | 9/1939 | Wintermute | |
| 2,174,328 | A | 9/1939 | Meston et al. | |
| 2,191,041 | A * | 2/1940 | Protz | 362/121 |
| 3,400,263 | A | 9/1968 | Yakim | |
| 3,694,648 | A | 9/1972 | Yates | |
| 4,060,722 | A | 11/1977 | Foley | |
| 4,219,870 | A | 8/1980 | Haraden et al. | |
| 4,228,486 | A | 10/1980 | Matsuya | |
| 4,339,787 | A | 7/1982 | Burnbaum | |
| 4,364,102 | A | 12/1982 | Huppert et al. | |
| 4,462,065 | A | 7/1984 | Rhodes | |
| 4,713,586 | A | 12/1987 | Chiang | |
| 4,757,099 | A | 7/1988 | Hoshino et al. | |
| 4,803,396 | A | 2/1989 | Kelner | |

(Continued)

FOREIGN PATENT DOCUMENTS

| | | |
|---|---|---|
| CN | 2475920 | 2/2002 |

(Continued)

OTHER PUBLICATIONS

Longwood Gardens—Seasonal Festivals—2000 Christmas, URL=http://www.longwoodgardens.org/SeasonalFestivals/Christmas/2000christmas.htm, download date Nov. 23, 2000.

(Continued)

*Primary Examiner*—David V Bruce
(74) *Attorney, Agent, or Firm*—Seed IP Law Group PLLC

(57) ABSTRACT

Light shades and lighting systems that create a spectral effect when a lighting element is illuminated within the shade, and features that reflect light originating within the shade. Embodiments of the invention incorporate hollow body having a diffraction grating thereon and an internal cavity to retain one or more lighting elements, and in some instances, to also retain one or more lengths of conductor.

13 Claims, 11 Drawing Sheets

U.S. PATENT DOCUMENTS 4,879,969 A 11/1989 Haranoya et al.
4,905,627 A 3/1990 Yoshikawa
4,992,914 A * 2/1991 Heiss et al. ..... 362/806
5,001,615 A 3/1991 Stefanelli
5,104,608 A 4/1992 Pickering
5,108,777 A 4/1992 Laird
5,150,964 A 9/1992 Tsui
5,233,680 A 8/1993 Fussell
5,250,331 A 10/1993 Grefalda
5,331,529 A 7/1994 Huang
5,367,433 A 11/1994 Blomquist
5,379,202 A 1/1995 Daun
5,394,315 A 2/1995 Ahroni
5,396,408 A * 3/1995 Szczech, III ..... 362/806
5,498,922 A 3/1996 Chang
5,517,390 A 5/1996 Zins
5,566,483 A * 10/1996 Ogren ..... 362/806
5,580,159 A 12/1996 Liu
5,626,415 A 5/1997 Huang
5,645,343 A 7/1997 Rinehimer
5,772,312 A 6/1998 Pihl-Niederman et al.
5,816,686 A 10/1998 Wang et al.
5,828,183 A 10/1998 Wang et al.
5,850,927 A 12/1998 Pan
5,861,128 A 1/1999 Vick et al.
5,915,827 A 6/1999 Wang
5,955,156 A 9/1999 Hermanson
5,969,469 A 10/1999 Wang
6,001,435 A 12/1999 Hardy et al.
6,164,793 A * 12/2000 Wu ..... 362/806
6,258,871 B1 7/2001 Brown, III
6,284,330 B1 9/2001 Hermanson
6,329,028 B1 12/2001 Bucher
6,334,974 B1 1/2002 Chen
6,394,282 B1 5/2002 Pan
6,413,594 B1 7/2002 Onishi
6,478,164 B1 11/2002 Pan
6,566,416 B2 5/2003 Brown, III
6,652,927 B1 11/2003 Chen
6,682,208 B1 1/2004 Pan
6,719,440 B1 4/2004 Wang
6,769,954 B2 8/2004 Su
6,830,361 B2 12/2004 Wang
6,854,863 B2 2/2005 Wu
6,905,229 B2 6/2005 Fan
7,086,757 B2 8/2006 Wang
7,303,312 B2 * 12/2007 Wang ..... 362/121
2002/0121295 A1 9/2002 Chen et al.
2003/0156405 A1 * 8/2003 Kim ..... 362/806
2003/0184829 A1 * 10/2003 Odhner et al. ..... 359/15
2003/0214809 A1 11/2003 Wong
2004/0100797 A1 5/2004 Yang
2004/0125594 A1 * 7/2004 Wu ..... 362/806
2005/0105288 A1 5/2005 Chen
2006/0147353 A1 7/2006 Wang
2006/0158888 A1 7/2006 Wang
2006/0274526 A1 * 12/2006 Weston et al. ..... 362/252

FOREIGN PATENT DOCUMENTS

CN 02272047.2 10/2003

OTHER PUBLICATIONS

ChristmasDepot.com—Outdoor Decorations Topiary Sculptures Menu, URL=http://web.archive.org/web/20020117044252/www.christmaspromotions.com/menu.cgi?S=Outdo..., archived as of Jan. 17, 2002.

ChristmasDepot.com—Christmas—Outdoor Decorations—Topiary Sculptures—Standing Deer—3 . . . , URL=http://web.archive.org/web/20020118074543/www.christmaspromotions.com/prod.cgi?6904, archived as of Jan. 18, 2002.

ChristmasLights, Etc.-christmas lights, pre-lit artificial christmas trees, outdoor decorations, URL=http://web.archive.org/web/20020121032518/http://www.christmaslightsetc.com/, archived as of Jan. 21, 2002.

Christmas Holiday Decorations by Brite Star, URL=http://web.archive.org/web/20010708003923/www.britestar.com/products.ASP?PID=1620&SID=..., archived as of Jul. 8, 2001.

Photographs taken on Nov. 16, 2005, Magicolor 100 Light String Set, Magicolor, Inc., Arlington, Texas, first sold Apr. 13, 2001.

* cited by examiner

LIGHT SHADES AND LIGHTING SYSTEMS

BACKGROUND OF THE INVENTION

1. Field of the Invention

The present invention relates to electric light shades, lighting displays and lighting systems.

2. Description of the Related Art

Many different designs of ornaments and lighted displays have been developed to help people decorate their houses and yards during particular holidays.

BRIEF SUMMARY OF THE INVENTION

The present invention is directed toward light shades and strings of lights. In one disclosed embodiment, the invention is directed toward a shade for use with at least one lighting element. The shade has a hollow body with an internal cavity large enough for at least one lighting element to be positioned therein; at least a portion of the hollow body is configured to allow light from inside the body to escape therefrom; at least a portion of the hollow body has features thereon for breaking up light to create a spectral effect; and the hollow body has an opening therein configured to allow a conductor to be routed to the at least one lighting element when the at least one lighting element is positioned in the internal cavity.

In another disclosed embodiment, the invention is directed toward a light having at least one lighting element, a conductor for coupling the lighting element to a source of electricity, and a hollow body having an internal cavity within which at least one lighting element is positioned. At least a portion of the hollow body is configured to allow light from inside the body to escape therefrom; at least a portion of the hollow body has features thereon for breaking up light to create a spectral effect; and the hollow body has an opening therein configured to allow the conductor to be routed to the at least one lighting element in the internal cavity.

In another disclosed embodiment, the invention is directed toward a light string having lighting elements, a conductor, and light shades. The conductor electrically couples the lighting elements together and is configured to couple the lighting elements to a source of electricity. The light shades are positioned at different locations along the length of the conductor. Each of the light shades has a hollow body with an internal cavity within which at least one of the lighting elements is positioned. At least a portion of the hollow body is configured to allow light from inside the body to escape therefrom; at least a portion of the hollow body has features thereon for breaking up light to create a spectral effect; and the hollow body has an opening therein configured to allow the at least one lighting element to be positioned within the hollow body.

BRIEF DESCRIPTION OF THE SEVERAL VIEWS OF THE DRAWING(S)

In order to assist understanding of the present invention, embodiments will now be described, purely by way of non-limiting example, with reference to the attached drawings, in which.

Figure 7A:
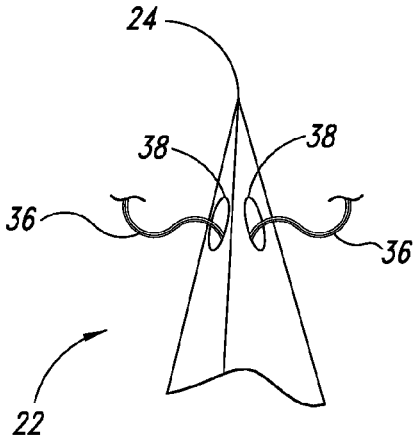
Figure 7B:
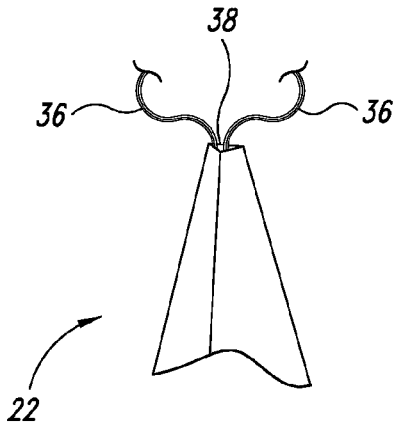
Figure 8:
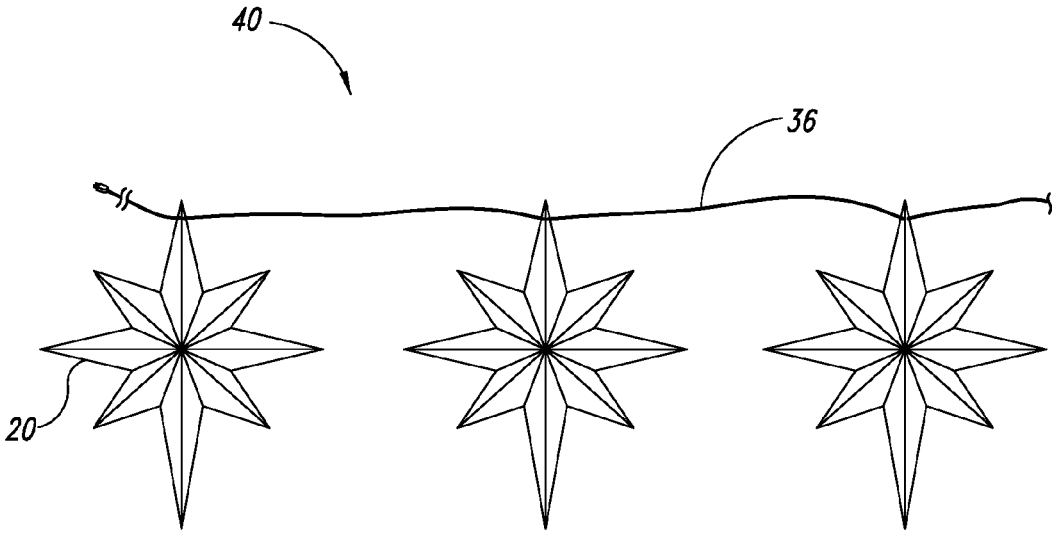
Figure 9:
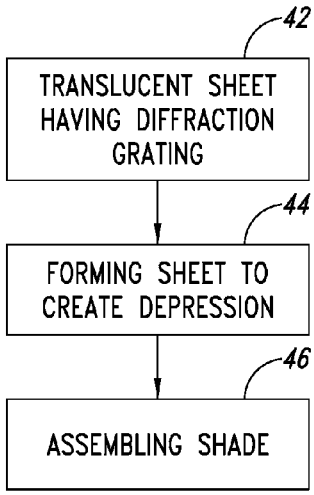
Figure 10:
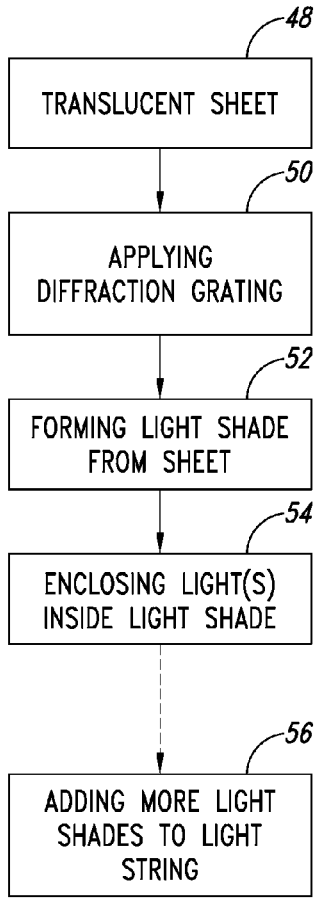
Figure 11:
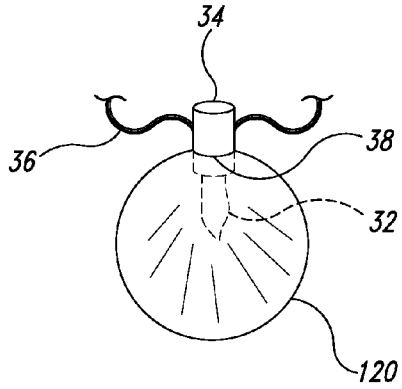
Figure 12:
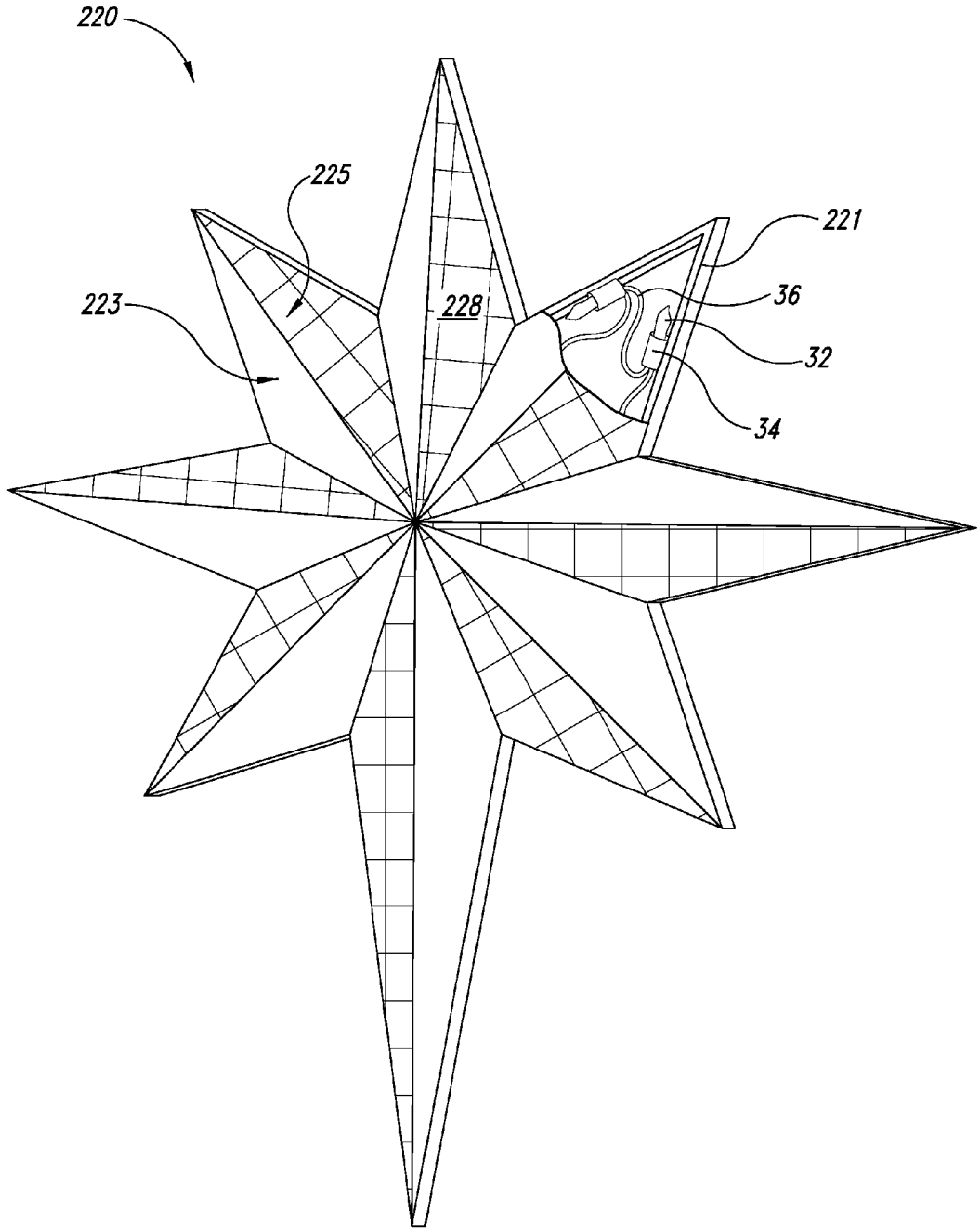
Figures 13A, 13B, 13C:
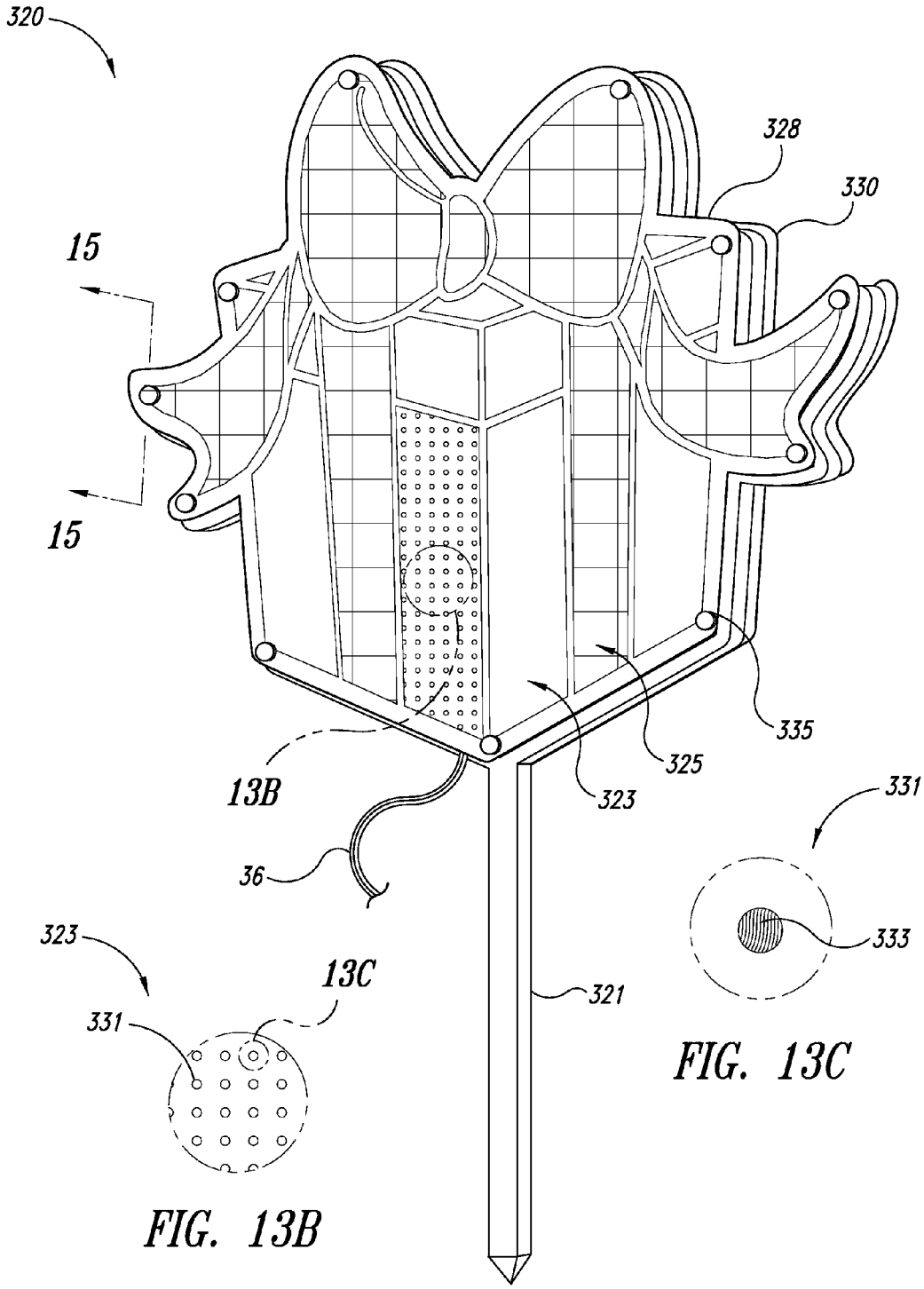
Figure 14:
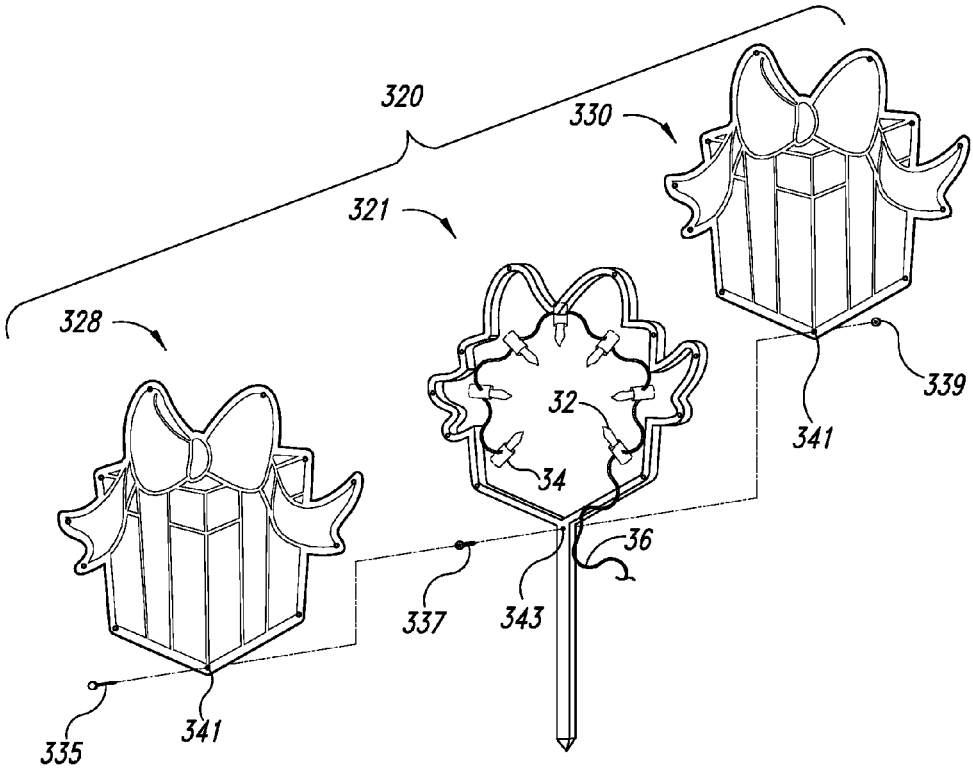
Figure 15:
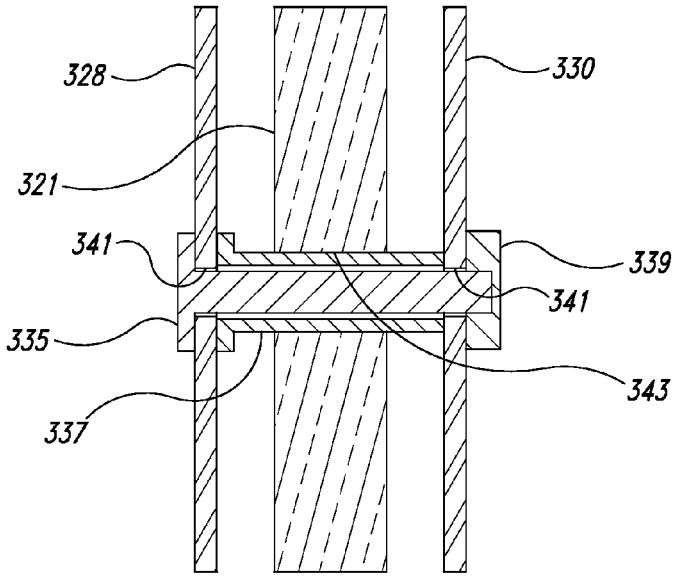

FIG. 7*a* is an enlarged isometric view of a portion of a light according to an embodiment of the present invention;

FIG. 7*b* is an enlarged isometric view of a portion of a light according to another embodiment of the present invention;

FIG. 8 is an isometric view of a light string according to an embodiment of the present invention;

FIG. 9 is a flow chart illustrating a method for manufacturing a light shade according to an embodiment of the invention;

FIG. 10 is a flow chart illustrating a method for manufacturing a light and a light string according to an embodiment of the present invention;

FIG. 11 is an isometric view of a light according to another embodiment of the invention;

FIG. 12 is an isometric view of a light shade according to another embodiment of the present invention;

FIG. 13A is an isometric view of a light display according to yet another embodiment of the present invention;

FIGS. 13B and 13C are enlarged views of portions of the light display of FIG. 13A;

FIG. 14 is an exploded isometric view of the light display of FIG. 13A; and FIG. 15 is a cross-section of a portion of the light display of FIG. 13A, viewed along Section 15-15.

DETAILED DESCRIPTION OF THE INVENTION

The present invention is directed toward devices and systems for use in decorating a home or yard during a holiday or other event. The following is a detailed description of a few illustrative embodiments. The drawings are provided to clarify the description, and may not be to scale.

Figure 1:
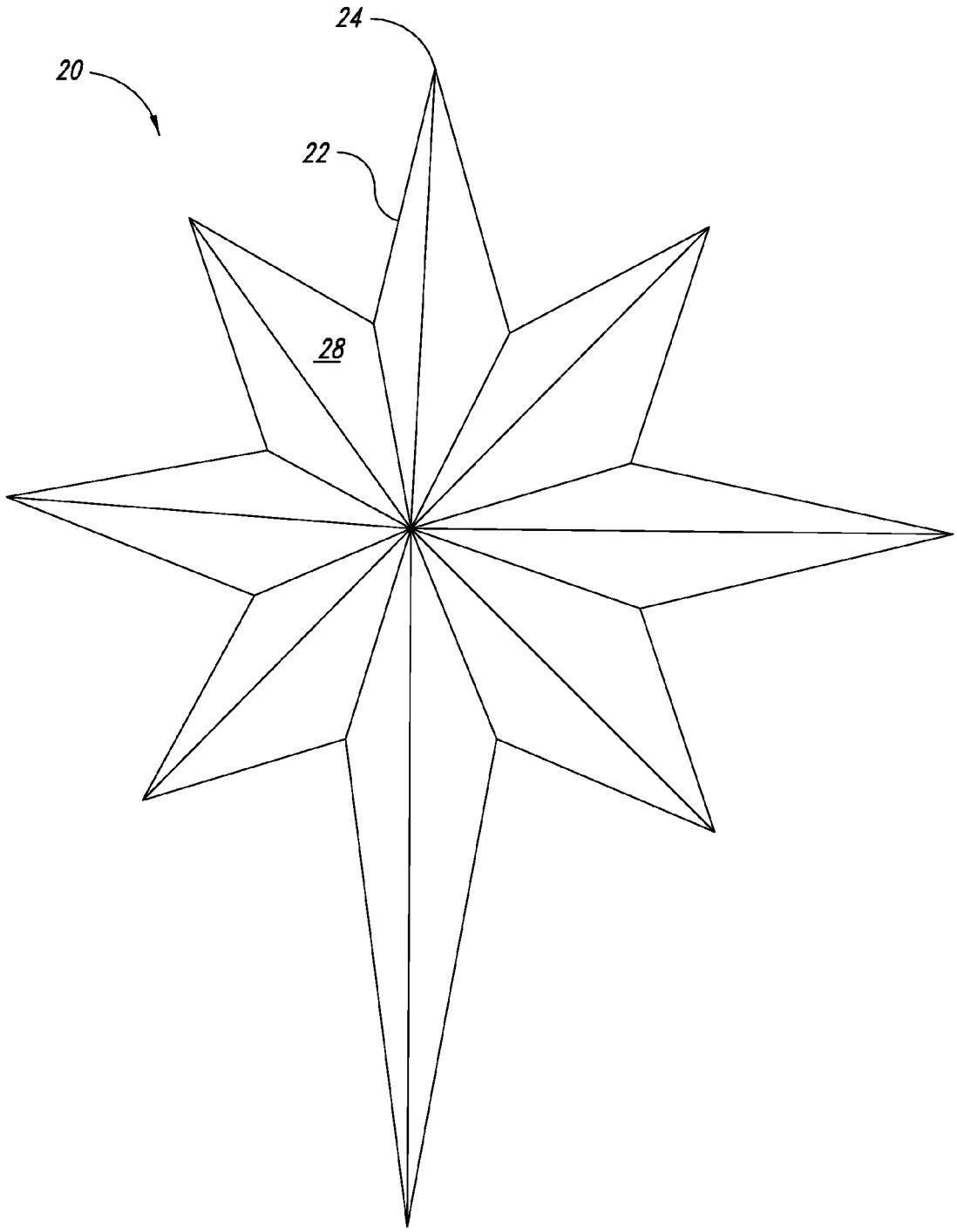
FIG. 1 is an isometric view of a light shade according to an embodiment of the present invention.
Figure 2:
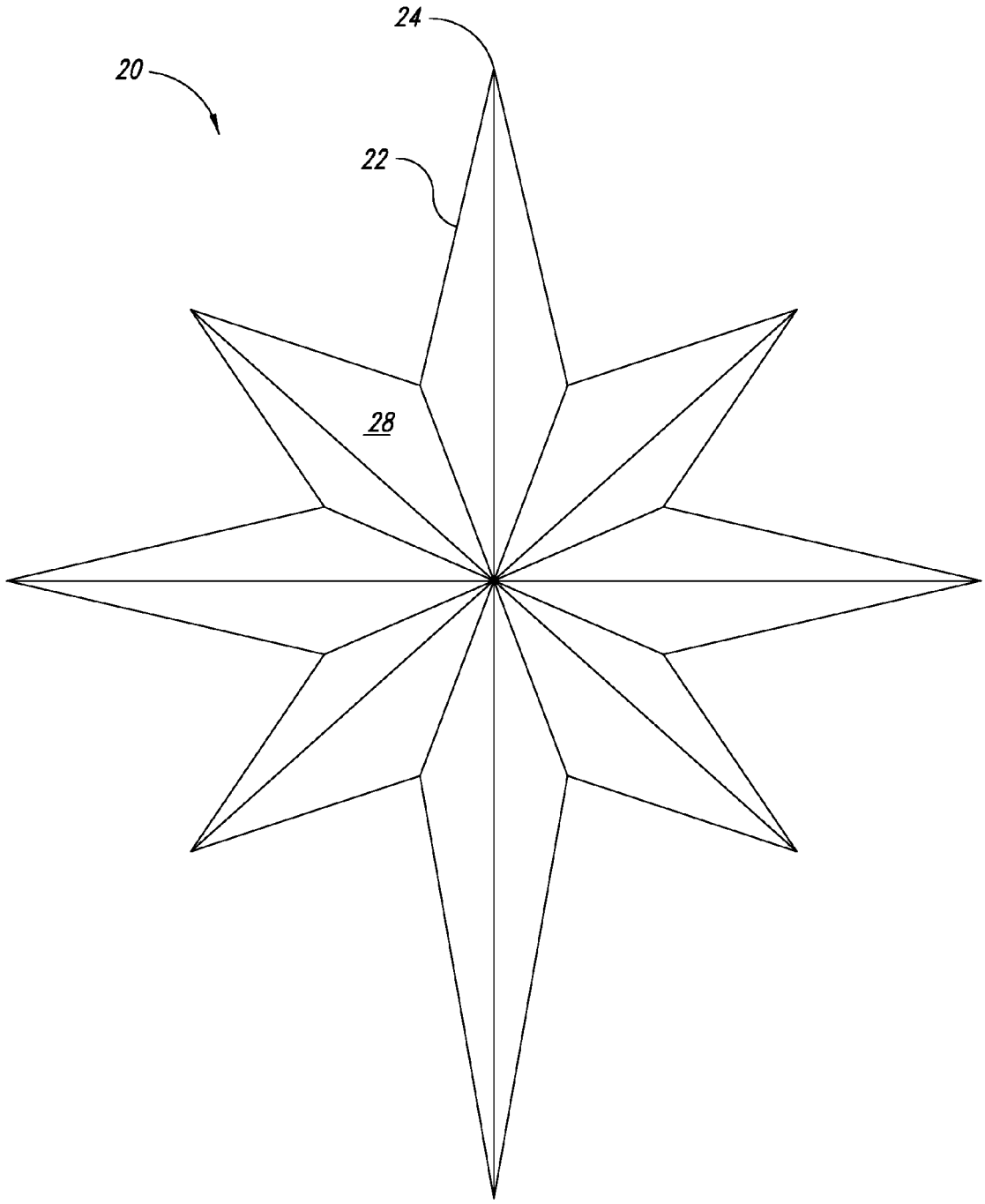
FIG. 2 is a plan view of the light shade of FIG. 1.
Figure 3:
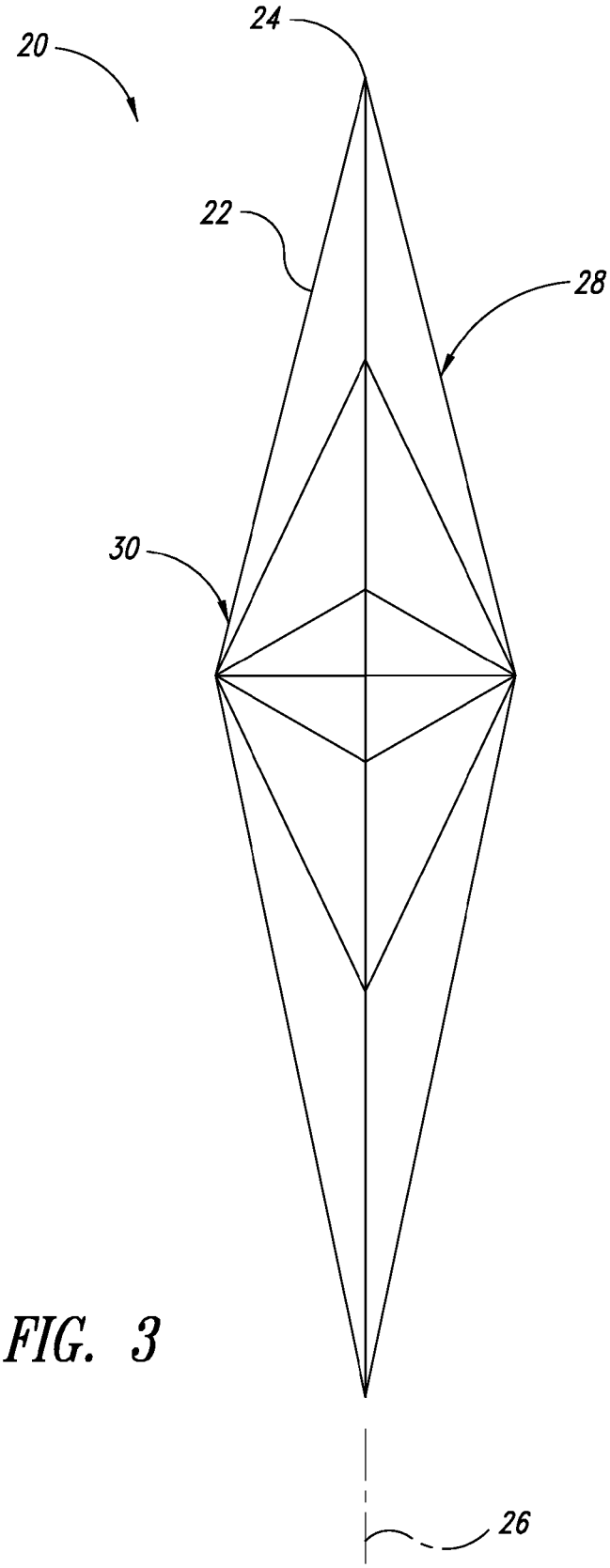
FIG. 3 is a side view of the light shade of FIG. 1.

FIGS. 1-5 illustrate a light shade 20 according to one disclosed embodiment of the present invention. The illustrated light shade 20 is star shaped, having four arms 22 each terminating in a point 24. As shown in FIG. 3, the illustrated light shade 20 is bilaterally symmetrical about a plane of symmetry 26, such that a front surface 28 of the light shade 20 is at least substantially identical to a back surface 30. Many different shapes could be used instead of a star shape without deviating from the spirit of the invention; and the front and back surfaces 28,30 need not by symmetrical. In certain embodiments, one of the front and back surfaces 28,30 is flat.

The front and back surfaces 28,30 of the illustrated embodiment are made from thin sheet material formed in three dimensions to create the shape of a faceted star. Accordingly, the contoured shape of the light shade 20 creates a corresponding internal cavity. The inventor appreciates that the hollow light shade 20 can be made through other means, such as by blow molding or other suitable means, without deviating from the spirit of the invention.

Figure 4:
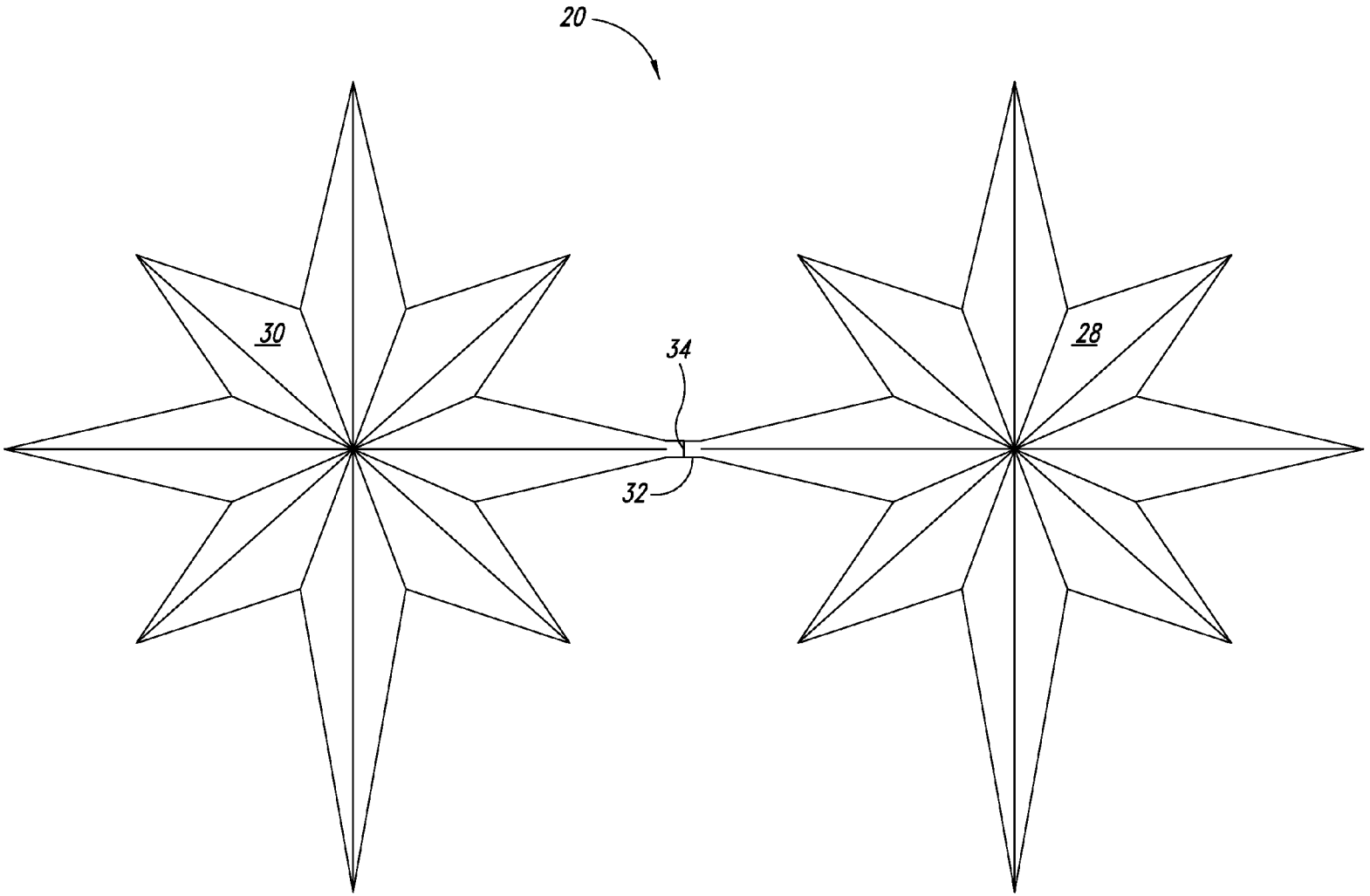
FIG. 4 is plan view of an unassembled light shade according to an embodiment of the present invention.
Figure 5:
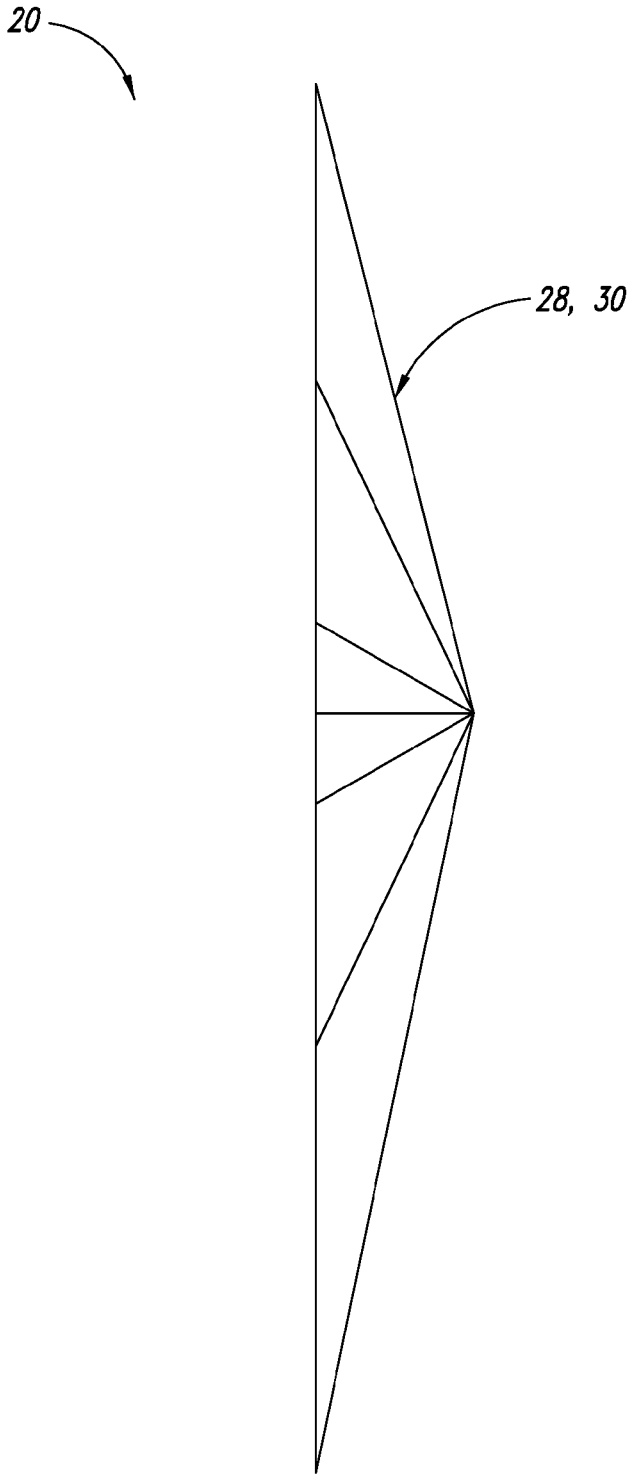
FIG. 5 is a side view of the unassembled light shade of FIG. 4.

As best illustrated in FIGS. 4 and 5, this particular light shade 20 is fabricated through a particular method. The front and back surfaces 28,30 are connected by a hinge 32, such as the living hinge illustrated in FIG. 4, which allows the surfaces to be rotated with respect to each other between an operating configuration, illustrated in FIGS. 1-3, and a non-operating configuration, illustrated in FIGS. 4 and 5. The non-operating configuration can be useful when, for example, assembling, storing, and/or transporting the light shade 20. The living hinge 32 can have perforations 34 or other features to facilitate correctly bending the front and back surfaces 28,30 to form the light shade 20. The inventor notes that the light shade 20 can be assembled through other means; and an individual of ordinary skill in the art having reviewed this disclosure will appreciate other means for assembling such a shade.

Figure 6:
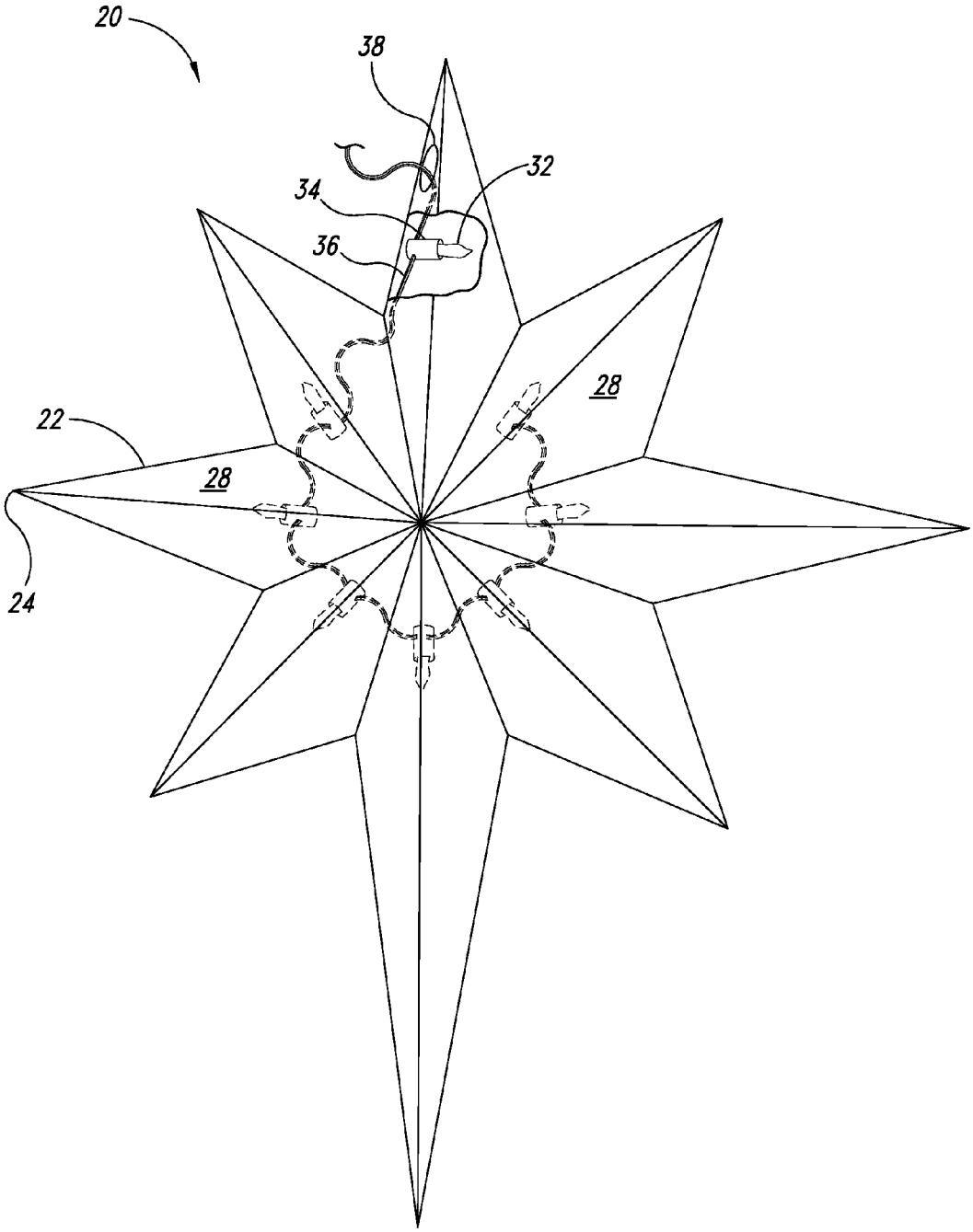
FIG. 6 is an isometric view of a light according to another embodiment of the present invention.

As illustrated in FIG. 6, the light shade 20 can be configured to hold one or more lighting elements therein, such as the illustrated light bulbs 32. Where several light bulbs 32 are retained within the body of the light shade 20, the cavity can also be configured to retain the corresponding sockets 34 and lengths of conductor 36. The conductor 36 enters the light shade 20 through an opening 38. In certain embodiments, as discussed below, the conductor 36 can also exit the light shade 20.

The material of the light shade 20 can be, as indicated above, formed from a thin sheet. In particular embodiments, the thin sheet is a translucent—and in some instances, a transparent—polymer treated to break light leaving the light shade 20 into some of its spectral elements. For example, the sheet can have a diffraction grating printed or otherwise formed thereon to diffract the light into various wavelengths, giving the light shade 20 a colorful, rainbow-like effect. Such treatment can cover select portions of the light shade 20 or can cover the entire light shade. As a result, the light originating with each of the light bulbs 32 passes through the skin of the light shade 20, breaking up into a spectral pattern and dispersing, giving the light shade a brilliant effect. Further, where the light display incorporates several light bulbs 32, such as that illustrated in FIG. 6, the display creates an even more brilliant effect when illuminated, as each light bulb creates its own spectral pattern.

FIGS. 7A and 7B illustrate two possible variations that can be made to the present invention. The embodiment illustrated in FIG. 7A incorporates two openings 38, which allow the conductor 36 to both enter and leave the light display 20 through separate holes. This embodiment may be useful, for example, where the light display is one of a string of displays; the conductor 36 leaving the light shade 20 can be routed to the previous or next light display in the string, or to a connector for coupling the light string to another string. The embodiment illustrated in FIG. 7B incorporates one opening 38 located at the extreme distal end of the point 24 on one of the arms 22. This particular embodiment may be useful, for example, where the light display is suspended by the conductor 36; the light shade 20 hanging vertically below the conductor due to the force of gravity. In other embodiments, the light display can be suspended from hooks, loops or other known hardware suitable for such purposes.

FIG. 8 illustrates a light string 40 having a number of light displays along the length of the conductor 36. The light displays in the illustrated embodiment incorporate light shades 20 according one of the embodiments of the present invention. The light string 40 can be modified to incorporate light shades 20 according to any of the embodiments disclosed herein, as well as any known light shades, in any desired combination.

FIG. 9 illustrates a method for making a light shade according to one particular embodiment of the present invention. In the disclosed embodiment, a translucent sheet is initially presented 42, having a diffraction grating or similar features thereon. The sheet is formed 44 to create a depression therein and, typically, to create a desired external shape. The formed sheet is then assembled 46 with one or more other sheets to form a light shade having a cavity therein. The other sheet or sheets can be flat or formed, and in instances such as those illustrated above, can be formed identical or similar to the first formed sheet. A light shade having one flat side may be more suitable than the other display for use against a wall or other flat surface, while the symmetrical style may be more desirable for being suspended in mid-air.

FIG. 10 illustrates a method for making a light display and, if desired, a string of lights, according to a particular embodiment of the present invention. In the disclosed embodiment, a translucent sheet is presented 48. A diffraction grating is applied 50 to the translucent sheet. The diffraction grating can be applied directly to the transparent sheet, or can be applied to a separate sheet which is, subsequently, affixed to the translucent sheet. The separate sheet can itself be translucent, but could instead be opaque and, in some instances, reflective. The translucent sheet is formed 52 into a desired shape. In some embodiments, the translucent sheet may be formed 52 after the diffraction grating is applied 50 to the sheet; however, in other embodiments, the diffraction grating may be applied to the sheet after it has been formed. After the sheet has been formed 52, lights are enclosed 54 within a light shade made using the formed translucent sheet. After the light shade has been made, several light strings may be added 56 to the string.

An individual of ordinary skill in the art, having reviewed this disclosure, will appreciate that the steps in the above methods can be exchanged in some instances, and/or can be combined in different sequences or without all of the other steps, to make other suitable light shades, light displays or light strings, without deviating from the spirit of the present invention.

FIG. 11 illustrates another possible configuration of a light shade 120 according to the present invention. In the illustrated embodiment, a single light bulb 32 is positioned within a cavity in the light shade 120. The opening 38 in the light shade 120 receives the socket 34, and the conductor 36 passes to and from the socket without entering the light shade.

FIG. 12 illustrates a configuration of a light display incorporating a light shade 220 according to still another possible embodiment of the present invention. In the illustrated embodiment, a front surface 228 similar to that illustrated and described in the first embodiment herein, is mounted to a frame 221, which can have an outer perimeter similar to an outer perimeter of the front surface. The front surface 228 can be glued to the frame 221, or can be affixed to the frame by any suitable means. The frame 221 can extend throughout portions of the light shade 220, and the sockets 34 for the light bulbs 32 can be attached to the frame at various places using known means. The conductor 36 is routed to the light sockets 34, and can enter and, if desired, leave the light shade 220 as discussed above.

The front surface 228 can have different portions, each portion affecting light in a different way. A first portion 223 of the front surface can be adapted to allow light to escape the light shade 220. The first portion 223 could include holes and/or translucent material (again, a term intended herein to incorporate transparent materials), and can be a material similar to that discussed in connection with the first embodiment, above. That is, the first portion 223 can incorporate a diffraction grating, either directly or through affixation, to break light leaving the light shade 220 into its spectral elements. In situations where the diffraction grating is affixed to the front surface 228 of the first portion 223, the inventor appreciates that the diffraction grating can be printed or otherwise applied to a strip of material that is then either applied smoothly over the surface or at angles to the surface to provide the light shade 220 with an even more brilliant effect.

The second portion 225 of the front surface 228 can be adapted to reflect light, externally and/or internally with respect to the light display. In addition, the second portion 225 can be adapted to refract light into some of its spectral elements, further increasing the brilliant effect of the light display. The second portion 225 can be covered with a metallic foil or with a paper that is itself covered with metallic foil, and/or can be printed or otherwise treated to create a diffraction grating over the reflective foil, thus both reflecting and breaking up light. The paper or foil can be smoothly affixed to the second portion 225 of the front surface 228, or can be bent, wrinkled or otherwise angled with respect to the surface to further break up the light and create a more brilliant effect.

In the illustrated embodiment, the front surface 228 is faceted such that the several first portions 223 of the front surface face the several second portions 225. As a result, light escaping the light shade 220 through the first portions 223 is directed, at least in part, toward the second portions 225. The light impinging the second portions 225 of the front surface 228 is then refracted, creating several spectral effects. Thus, even though half of the front surface 228 in the illustrated embodiment is opaque, all of the front surface can create spectral light, making the entire lighted display 220 brilliant.

FIGS. 13-15 illustrate a light display incorporating a light shade 320 according to still another embodiment of the present invention. In the illustrated embodiment, a frame 321 similar in structure to that disclosed above and illustrated in the corresponding drawings, is interposed between a front surface 328 and a back surface 330. A conductor 36 and several light bulbs 32 and sockets 34 are positioned within an internal cavity delimited by the frame 321 and the front and back surfaces 328,330.

The illustrated front surface 328 is a flat, translucent sheet of material, such as a polymer or resin-based material, having indicia thereon to create a desired decorative effect. A first portion 323 of the front surface 328 can be translucent and can be treated or covered with light-diffracting features such as those disclosed above in connection with the first surface 223 in a previous embodiment. A second portion 325 of the front surface 328 can be colored, opaque and/or treated to diffract and/or reflect light, such as that discussed above in connection with the second portion 225 in a previous embodiment. The first and second portions can be randomly selected or can be selected to create a desired image, such as the present shown in the figures. The inventor intends this image to be merely an example, and appreciates that any other desired design could be used instead.

The back surface 330 can be similar to the front surface 328 or can be a simple sheet of material, translucent or opaque, depending on the desired use of the display. In addition, the interior of the back surface 330 can be reflective to direct additional light toward—and through—the front surface 328. The back surface 330 could also be formed and contoured similar to one of the surfaces described in the first embodiment, above, to give the display two distinct designs, depending on the direction the display is facing. One of ordinary skill in the art, having reviewed this disclosure, will appreciate these and other variations and modifications that can be made to the disclosed embodiments without deviating from the spirit of the invention.

As illustrated in FIGS. 13B and 13C, the first portion 323 of the front surface 328 can have deposits 331 thereon, which can be dispersed across the first portion in a pattern, array, or other distribution. The deposits 331 can be small enough not to distract an individual viewing the light display, while being large enough to reflect, refract and/or diffract light that impinges the deposit. In the illustrated embodiment, the deposits 331 are made with a material having reflective properties, and have a diffraction grating 333 thereon so that light impinging the deposits from outside the light display is reflected and diffracted, creating a brilliant spectral effect. Between the deposits 331, the first portion 323 of the front surface 328 can be translucent, allowing light to escape the light shade 320.

As best illustrated in FIGS. 14 and 15, the disclosed light display is assembled such that the front surface 328 and/or back surface 330 is spaced apart from the frame 321. In the illustrated embodiment, the front surface 328, frame 321 and back surface 330 are coupled together and spaced apart using a rivet-type fastener 335, a bushing 337, and a cap 339. The rivet-type fastener 335 passes through corresponding holes 341 in the front and back surfaces 328, 330. Between the front and back surfaces 328,330, both the rivet-type fastener 335 and the bushing 337, surrounding the rivet-type fastener, pass through a hole 343 in the frame 321. The cap 339 is fixed to a distal end of the rivet-type fastener 335 on the external side of the back surface 330. The inventor appreciates that many other means can be used to assemble and, if desired, space apart the front surface 328, the frame 321, and the back surface 330.

From the foregoing it will be appreciated that, although specific embodiments of the invention have been described herein for purposes of illustration, various modifications may be made without deviating from the spirit and scope of the invention. Accordingly, the invention is not limited except as by the appended claims.

The invention claimed is:

1. A lighted ornament comprising:

a first member having a first outer boundary with a desired first shape;

a second member having a second outer boundary with a shape similar to the first member;

a spacer fixedly coupled to the first and second members, the spacer configured to space apart the first member from at least a portion of the second member, wherein the spacer comprises a bushing and a rivet configured to fixedly couple the spacer to at least one of the first and second members;

an internal cavity defined by the first member, the at least a portion of the second member, and the spacer, the internal cavity being large enough for at least one lighting element to be positioned therein, at least a portion of the first member being configured to allow light from inside the internal cavity to escape therefrom and the first member comprising features thereon for breaking up light; and at least one lighting element positioned within the internal cavity.

2. The lighted ornament of claim 1, wherein the spacer is configured to engage a passage defined by corresponding holes in the first and second members, wherein the first member is fixedly coupled between a first portion of the spacer on an external portion of the first member and a second portion of the spacer on an internal portion of the first member, and wherein the second member is fixedly coupled between a third portion of the spacer on an external portion of the second member and a fourth portion of the spacer on an internal portion of the second member.

3. The lighted ornament of claim 1 wherein at least some of the features for breaking up light are incorporated into a surface of the lighted ornament.

4. The lighted ornament of claim 1 wherein at least some of the first member's features for breaking up light are configured to create a spectral effect.

5. The lighted ornament of claim 1 wherein the cavity is large enough to hold a plurality of lighting elements and a conductor connecting the lighting elements together.

6. The lighted ornament of claim 1 wherein the first and second members are generally planar and generally parallel to one another.

7. A lighting device comprising:

a first sheet;

a second sheet having light refractive properties and offset from the first sheet, the first and second sheets defining opposing outermost surfaces of a shape, wherein the first sheet and the second sheet are generally parallel to one another and wherein the first and second sheets each have a similar shape to one another;

a structure disposed between and fixedly coupled to the first and second sheets, the structure being configured to space apart the first and second sheets, wherein the structure comprises a rivet-type fastener comprising a bushing and a pair of caps, wherein the caps are configured to pass from an external side of the lighting device through corresponding holes in the first and second sheets and into opposing ends of the bushing on an internal side of the lighting device, and wherein the lighting device is coupled between the cap and the bushing; and a light source positioned between the first and second sheets, the light source configured to emit light though at least one of the first and second sheets.

8. The lighting device of claim 7 wherein the structure further comprises a frame member.

9. The lighting device of claim 7, wherein the structure has a similar shape to the first and second sheets.

10. The lighting device of claim 7, further comprising a plurality of light sources positioned generally in a plane that is substantially parallel to at least one of the first and second sheets.

11. A method of manufacturing a lighting device, comprising:

providing a first member, at least a portion of the first member having light refractive properties configured to allow light to pass therethrough;

providing a second member, wherein the first and second members are configured to define opposing outermost surfaces of a shape;

placing the first and second members on opposing sides of a structure, wherein the structure spaces the first and second members apart from one another; and fixedly coupling the first and second members to the structure with at least one fastener wherein the structure comprises a bushing and the fastener comprises a rivet.

12. The method of claim 11, further comprising at least one lighting element positioned between the first and second members.

13. The method of claim 11, wherein the first and second members are generally planar and generally parallel to one another.

* * * * *